US005881505A

United States Patent [19]

Larkin, III et al.

[11] Patent Number: 5,881,505

[45] Date of Patent: Mar. 16, 1999

[54] FREE-STANDING, PREFABRICATED CREMATION MEMORIAL FOR CREMATION REMAINS

[76] Inventors: Alma J. Larkin, III, 6807 Pine Rock Cir., Salt Lake City, Utah 84121-3405; Robert M. Wallace, 3110 S. Monte Cristo Way, Las Vegas, Nev. 89117

[21] Appl. No.: 797,256

[22] Filed: Feb. 7, 1997

Related U.S. Application Data

[60] Provisional application No. 60/011,332 Feb. 8, 1996.

[51] Int. Cl.[6] ..... E04H 13/00

[52] U.S. Cl. ..... 52/136; 52/139; 52/142; 27/1; 211/85.27

[58] Field of Search ..... 52/103, 128, 134, 52/136, 137, 139, 142; 27/1; 211/85.16, 85.27, 188

[56] References Cited

U.S. PATENT DOCUMENTS

| | | | |
|---|---|---|---|
| 343,671 | 6/1886 | Miles | 52/103 |
| 1,008,421 | 11/1911 | MacKay | 52/134 X |
| 1,406,192 | 2/1922 | Kennedy | 52/134 X |
| 1,453,375 | 5/1923 | Allen | 52/134 |
| 1,585,411 | 5/1926 | Patterson | 52/134 |
| 2,513,951 | 7/1950 | McClellen | 27/1 |
| 3,183,574 | 5/1965 | Diem . | |
| 3,254,773 | 6/1966 | Diem | 27/1 X |
| 3,417,521 | 12/1968 | Welsh . | |
| 3,529,730 | 9/1970 | Thompson | 52/134 X |
| 3,754,805 | 8/1973 | Pangburn et al. . | |
| 3,841,726 | 10/1974 | Andros et al. . | |
| 3,925,944 | 12/1975 | Pickel . | |
| 3,958,378 | 5/1976 | Omeechevarria . | |
| 4,521,999 | 6/1985 | Flanagan | 52/103 |
| 4,607,417 | 8/1986 | Hancovsky . | |

FOREIGN PATENT DOCUMENTS

| | | | |
|---|---|---|---|
| 2607858 | 6/1988 | France | 52/128 |
| 204882 | 8/1939 | Switzerland | 27/1 |

*Primary Examiner*—Carl D. Friedman
*Assistant Examiner*—Laura A. Callo
*Attorney, Agent, or Firm*—Trask, Britt & Rossa

[57] ABSTRACT

A free-standing cremation memorial for holding cremated remains has a plurality of chambers in a vertical portion of the structure as well as a number of chambers in the base unit. A base member prefabricated of aluminum framework with at least about 10 underground chambers is provided. An upright framework supported on said base in which a large number of niches is provided. A base member, which is supported on concrete footings, is a three-dimensional framework which provides support for the upright portion of the cremation memorial, which is also prefabricated framework.

7 Claims, 13 Drawing Sheets

CREMATION MEMORIAL
AXIONOMETRIC VIEW

CREMATION MEMORIAL
AXIONOMETRIC VIEW

EXCAVATION AND FOUNDATION PLAN

PLAN VIEW

SIDE ELEVATION

FRONT VIEW

SIDE VIEW
FRAME (C)

SIDE VIEW
FRAME (D)

UNDERGROUND ALUMINUM BOX

UNDERGROUND ABS BOX

ABOVE GROUND ALUMINUM BOX

UNDERGROUND COMMON CREMAINS BOX

FREE-STANDING, PREFABRICATED CREMATION MEMORIAL FOR CREMATION REMAINS

BACKGROUND OF THE INVENTION

Priority Claim

Under the provisions of 35 U.S.C. § 1.19(e), this application claims the priority of Provisional Patent Application Ser. No. 60/011,332, filed Feb. 8, 1996.

Field of the Invention

The instant invention relates to mausoleums for holding cremation remains.

State of the Art

Various types of repositories have been constructed for holding cremated remains. Frequently these are concrete structures made in a typical poured concrete construction. Other structures such as those illustrated in Diem (U.S. Pat. No. 3,183,574) and Pangburn, et al. (U.S. Pat. No. 3,754,805) utilize rod structures whereby a framework may be formed from rods and other members similar to a tinker toy-type construction. A somewhat similar construction is illustrated in Andros, et al. (U.S. Pat. No. 3,841,726).

These structures involve lattice-type frameworks, which generally may be constructed and assembled on site. Panels are joined to the interior of such a framework to form niches of various types. Cover plates are attached to the lattice-like framework to cover the open end of a niche. As noted in Andros, the Diem construction is designed to accommodate a specially constructed urn having a generally hexagonal cross-sectional shape. Generally, as referred to further in Andros, the structures of Diem and Andros are intended for permanent side-by-side arrangement against the walls of a building referred to as a columbarium. Legs or slides are provided on the bottom of the device to facilitate sliding these assemblages against a wall.

Generally, the devices of Pangburn, Diem and Andros give no indication that they are intended for an outdoor location or as a free-standing unit. As indicated in Diem, the frame is employed against a wall and the urns are slid or lifted in and out of only one side of the frame. The structures illustrated in Pangburn and Andros appear similar to Diem in that regard. Thus, the units do not have to be weatherproof or withstand wind loads.

Underground chambers have also been proposed such as those disclosed in Hancovsky (U.S. Pat. No. 4,607,417) where an overhead frame is anchored to a footing member and has depending chambers attached to it.

Another structure is disclosed in Pickel (U.S. Pat. No. 3,925,944), which again appears to be a unit for use inside a building since there is no indication of any other type of support.

SUMMARY

The instant invention relates to a weather-resistant cremation memorial, i.e., mausoleum, for placement outdoors wherein a substantially prefabricated base structure containing chambers provides support for a free-standing, upright portion containing vertically-arranged niches. For the purposes of the instant invention description, the term "niche" is used to define a single compartment in the upright portion of the cremation memorial, while the term "chamber" defines a single compartment in the cremation memorial base. Each niche may have space for numerous urns. For example, in the detailed embodiments described herein, each niche is dimensioned so that it may contain upwards of eight cremation urns. Each chamber, likewise, may contain numerous urns or may be constructed to contain remains directly without use of urns.

The base structure of the cremation memorial is a three-dimensional frame which is supported upon a plurality of substantially parallelly spaced footers wherein the chambers in the base are all at a level above the footers. The upright portion of the cremation memorial is also an open-frame, prefabricated structure which fits upon and interlocks with the base structure. The upright structure has a height and length which is generally greater than its thickness (width). The length of the upright structure runs transversely to the elongated footers.

The free-standing cremation memorial is constructed of prefabricated, open framework structures so that final assembly at a site may be readily performed. Since the structure is free-standing and intended for outdoor installation, it is designed and constructed to withstand wind speeds of up to 110 miles per hour. A minor change is required in the foundation width, that is the width of the footers, to construct the cremation memorial to withstand various maximum wind forces. The framework structure of the cremation memorial is made out of structural aluminum, typically with a box-shape cross-section, in order to provide the necessary strength to resist high wind forces. The free-standing, upright cremation memorial, in one embodiment, is about twelve feet long and eight feet high with a thickness (width) of about 1½ feet. Such a structure may have upwards of 24 niches on each face of the upright structure and upwards of 10 individual chambers in the base. In addition, access is provided to a common ashes or cremated remains portion in the central portion of the base structure under the upright structure. The base structure is typically about 12 feet long, about seven feet wide and about 2½ feet deep excluding footer dimensions.

DETAILED DESCRIPTION OF THE ILLUSTRATED EMBODIMENT

The instant invention relates to a free-standing cremation memorial for cremated remains. The cremation memorial or mausoleum of the instant invention is structured to be situated in an outside environment where it may be exposed to the elements including high wind forces. The free-standing cremation memorial comprises a base frame, which is an open three-dimensional framework constructed of heavy-duty structural aluminum members. The base section is structured so that it may contain a plurality of cavities, for example, typically up to about ten chambers in which multiple cremation remains may be placed in each chamber. Further, the base section supports the upright section, which is also an open framework structure made of structural aluminum box-shaped tubing members. Further description of the invention may be facilitated by reference to the attached drawings.

Figure 1:
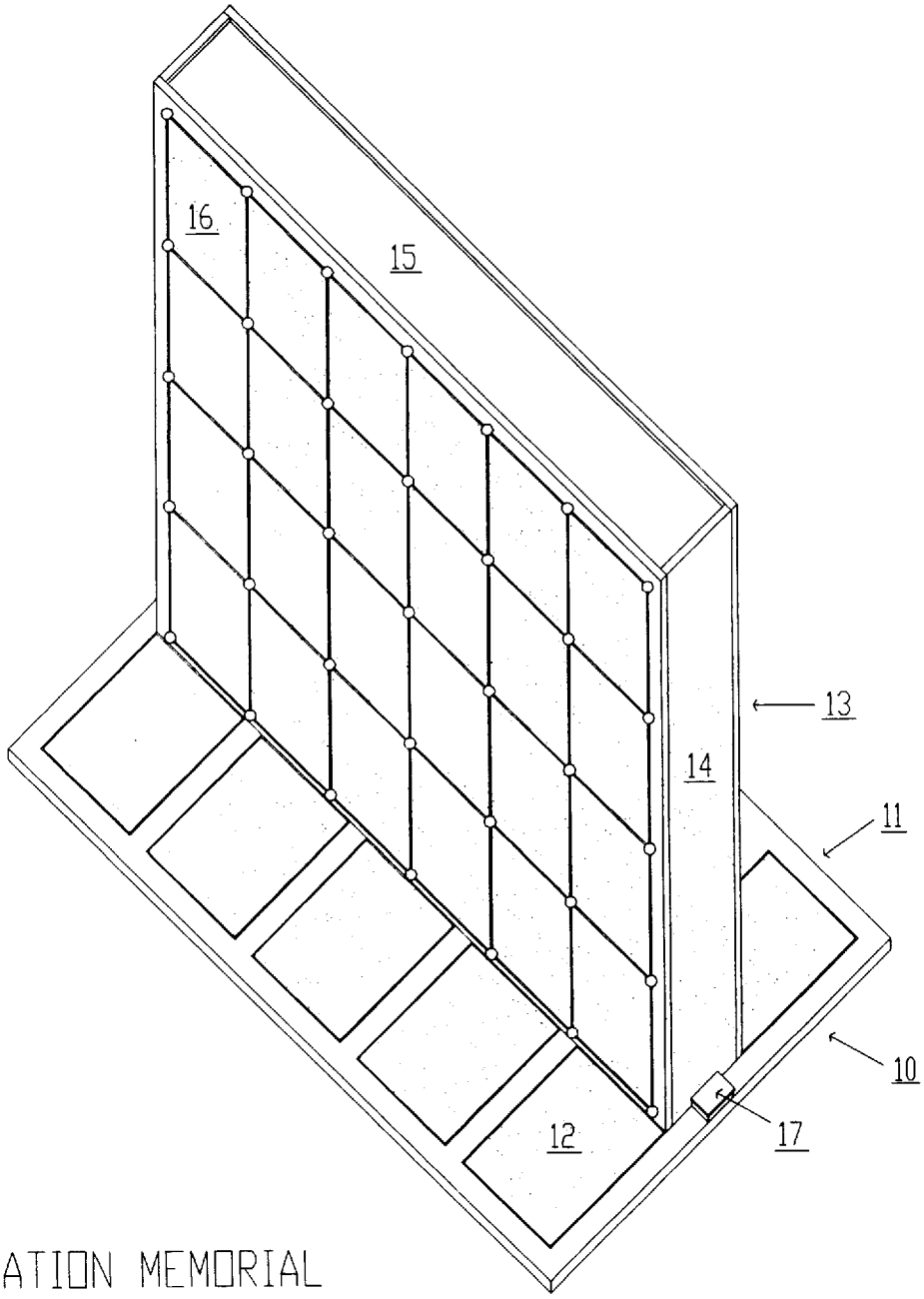
FIG. 1 is a perspective view of the free-standing cremation memorial of the instant invention.

FIG. 1 is a perspective view of the substantially prefabricated, free-standing cremation memorial (mausoleum) of the instant invention. A base section 10 is shown as it would be seen aboveground. The frame of the base is not shown completely as much of it is generally positioned underground. A framework 11 for the base 10 is constructed of structural aluminum members. Generally, in a preferred square cross-sectional embodiment, such structural members are about three to four inches in width and one-eighth inch thick and extend around the periphery of the base section. Multiple lids 12 fit over the underground chambers contained in the base member 10. The lids 12 are preferably made of granite or other attractive stone or durable, strong material, such as glass, bronze or the like.

An upright mausoleum structure 13 is positioned transversely across the base structure 10 and is attached securely thereto and supported by the base structure. Each end surface or panel 14 of the upright structure 13 is preferably covered by a granite panel, while the top panel 15 may be of aluminum or other metal. Optionally, it could be granite or some other attractive stone. Doors 16 for each compartment side are preferably made of granite or similar attractive stone, bronze, glass or the like, and cover the vertically-oriented niches behind the doors. The upright structure 13 is made with compartment doors on each face portion. In the upright structure 13 a total of 48 niches, 24 niches opening on each upright face, may be provided while in the base structure 10, upwards of ten large underground chambers are provided. Also, a large common chamber is contained in the base directly under the upright portion. It is accessed by small doors 17 on either end of the base section 10.

Figure 2:
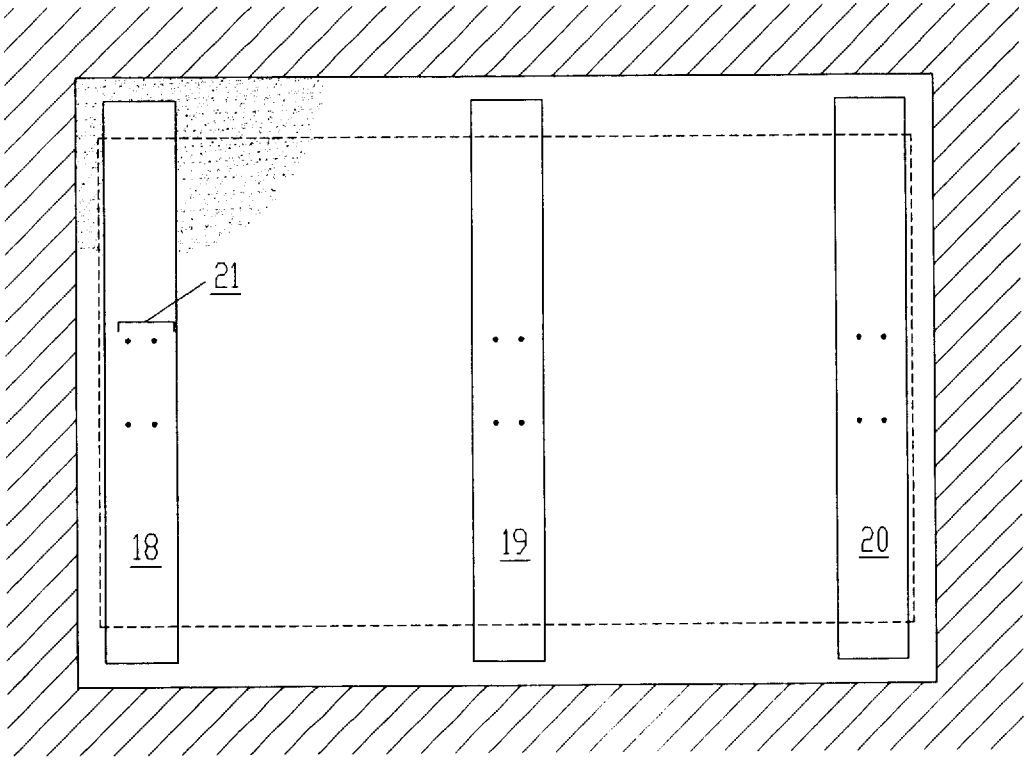
FIG. 2 is a plan view of the foundation arrangement for the free-standing cremation memorial.

FIG. 2 is a plan view of the foundation for the free-standing cremation memorial. A plurality, e.g. three footers 18, 19 and 20, is positioned and spaced so that the base section 10 will be positioned upon the footers with the footers running in the direction of the shorter dimension of the base section 10. The footers 18, 19 and 20 may be prefabricated or poured in place. Thus, the longer dimension of the upright portion 13 of the cremation memorial will run transverse to the footers. The footers may be from about one to two feet in width and are made of good quality, construction-grade, reinforced concrete. The width of the footers may vary, but is generally from about one to about two feet. While the longer dimension of the footers depends upon the width of the particular base section of the free-standing cremation memorial, a typical longer dimension for the footers may be anywhere from about 80 to about 120 inches, although typically it may be in the range of about 90 to about 100 inches.

Since the top of the base section 10 is intended to be at ground level, the top surface of the footers will be below the ground surface a distance which represents the depth of the base section framework. Although various means may be provided for attaching the base section to the footers, it is preferred to use anchor bolts. Typically, four anchor bolts are placed centrally in each footer. Thus, the base section 10 is held in place by about twelve anchor bolts. More anchor bolts may be utilized if deemed desirable. Heavy-duty flange 25B, 26B and 27B (see FIG. 5) are attached, e.g., welded, to the base frame and mate with the anchor bolts in the footers.

Figure 3:
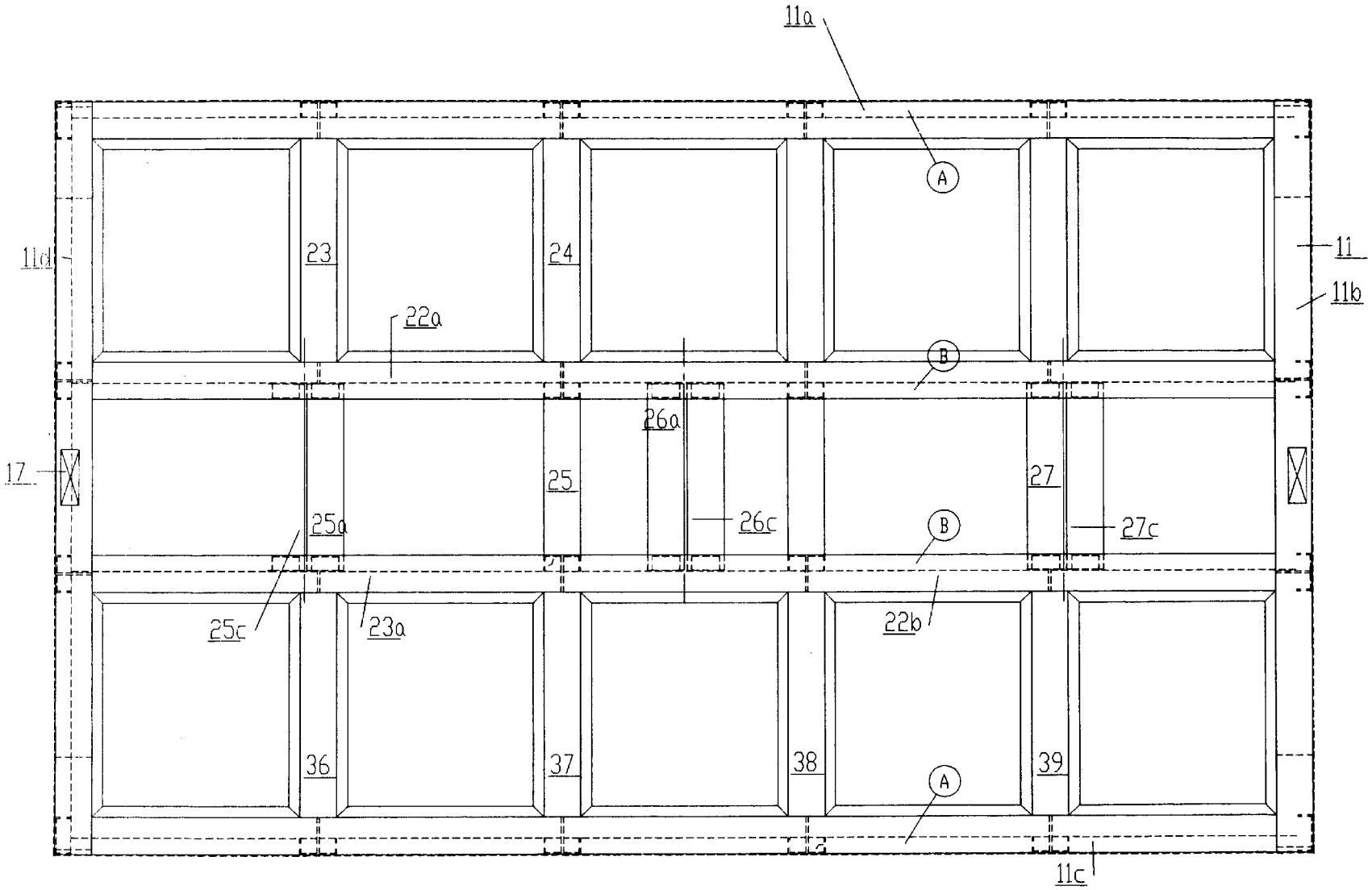
FIG. 3 is a plan view of the open frame base section.

FIG. 3 is a detailed plan view of the base section 10 of the free-standing cremation memorial illustrating the various structural aluminum members which are positioned in a grid-like manner to make a strong, stable base for the free-standing cremation memorial. The aluminum members are preferably of a box-shape cross-section, i.e., channels of either a square or rectangular cross-section. Such members are typically heavy-duty structural members.

A particular base member shown is one in which five chambers are to be positioned on either side of the central upright section. Circumscribing frame 11 around the top portion of the base is constructed of heavy-duty aluminum box channel members which have a web of about four inches in thickness and legs or sides of about one and three-quarter with a one-eighth inch thickness. Four such frame members 11A, 11B, 11C, and 11D make up the top outer frame 11 of the base section. Another pair of channel members 22A and 23A run parallel to one another and connect the end channel members 11B and 11D. These transverse aluminum channel members 22A and 23A, in conjunction with the external frame or outer frame members, form the space in which the chambers may be placed underground. Double bearing bars 25A, 26A and 27A are welded to members 22A and 23A. These bearing bars are solid, rigid supports which are positioned directly below the upright framework portion and help hold the whole assembly in place. Other transverse stringers 28 and 29 are positioned between the members 22A and 23A for structural support and rigidity. Upright flange members 25C, 26C and 27C are welded to double bars 25A, 26A and 27A. These flange members are welded or bolted to a matching plate secured between vertical frame members on the upright framework portion of the cremation memorial.

The length of the base frame illustrated in FIG. 3 may be anywhere from about 10 to 15 feet, with a length of approximately 12 feet being desirable. The width may be generally any width from about 6 to about 8 feet with a width of about 7 feet being desirable. The double bar members 25A, 26A and 27A are substantially similar to one another and serve as support members for the three upright sections to be attached to each pair of channels.

Figure 4:
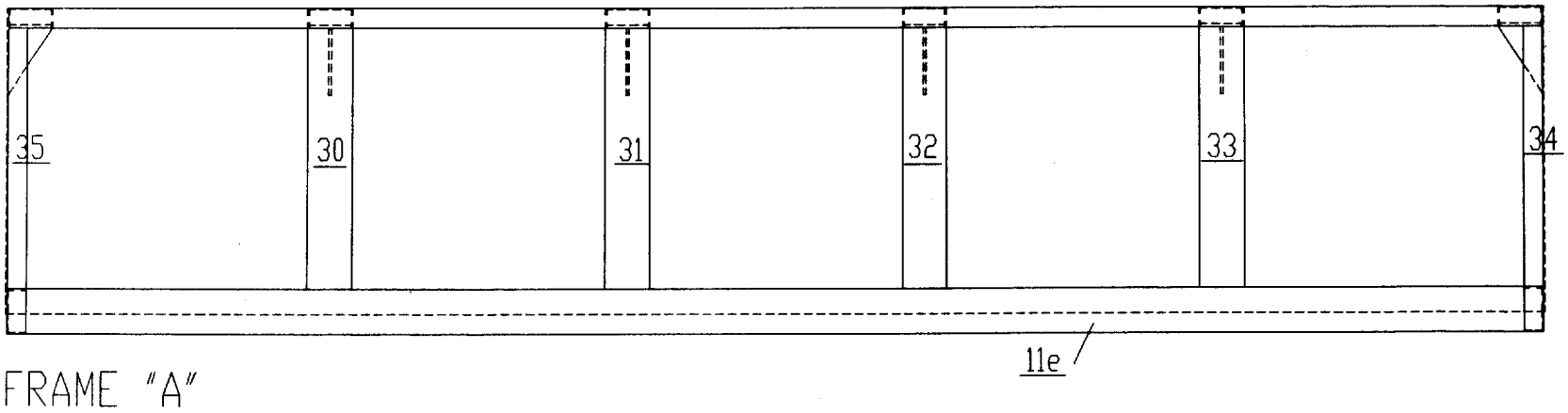
FIG. 4 is an elevational view of one side of the base structure of FIG. 3.
Figure 5:
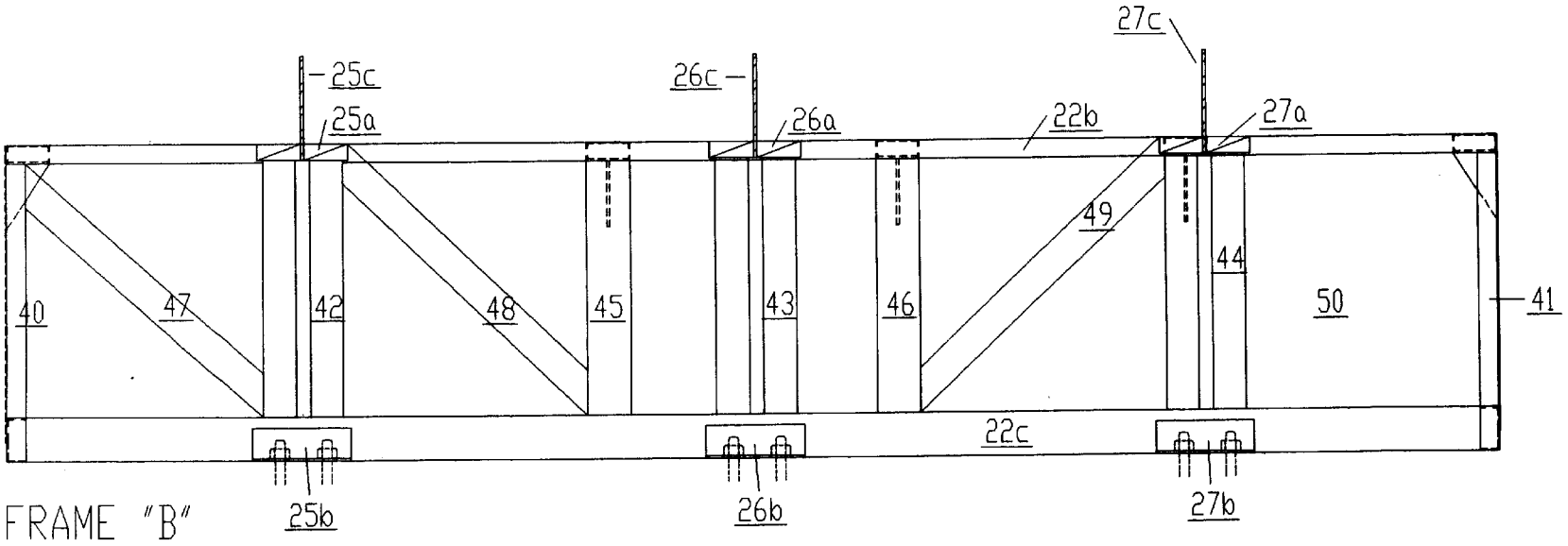
FIG. 5 is an elevational view of the center frame structure of the base structure of FIG. 3.

FIGS. 4 and 5 show elevational views of the base framework structure 10. FIG. 4 illustrates the framework 11 in its vertical dimension, while FIG. 3 illustrates the framework in its horizontal aspect, i.e. a plan view. Member 11C is attached by aluminum box channel members 30, 31, 32 and 33 to box channel member 11E and channel members 34 and 35 complete the vertical framework of the bottom portion of the structure. Spaces of about one and one-half feet to about two feet reside between members 30, 31, 32 and 33 and between members 36, 37, 38 and 39. The vertical members 30, 31, 32 and 33 are at right angles to members 36, 37, 38 and 39 shown in FIG. 3 and are upon similar spacing. The base framework structure is made to have a truss-like, three-dimensional construction.

FIG. 5 illustrates the vertical arrangement of the members which form the central section of the structure. Solid bar members 25D, 26D and 27D (not illustrated) are located directly under bar members 25A, 26A and 27A. Bar members 25D, 26D and 27D are attached to the footers which provide the foundational support for the whole cremation memorial structure. A continuous elongated aluminum box member 22C is positioned immediately below member 22B. Opposing member 22D, not shown, is similar to box member 22C and would be directly below member 22A (see FIG. 3).

Heavy-duty, L-shaped flanges 25B, 26B and 27B are attached, e.g. welded, to box-shaped structural member 22C adjacent double upright box channels 42, 43 and 44. The flanges are filled with bolt holes and provide a strong member to be bolted to the footers.

Upright members 40 and 41 are corner members made of aluminum box-shaped structural members one and three-quarter inch by four inch by one-eighth inch thick. The overall height of the frame illustrated in FIG. 5 is from about two feet to about two and one-half feet, preferably.

Upright members 42, 43 and 44 are double channel members attached respectively to members 25A and 25D (not shown), 26A and 26D (not shown), and 27A and 27D (not shown) to form strong support structure above the footings to support the upright portion of the cremation memorial. Upright support members 45 and 46 are aligned with horizontal members 36 and 38 (see FIG. 3).

Cross members 47, 48, 49 and 50 provide rigidity to the structure. The members are typically a ¼ inch thick plate having a width of about four inches.

Figure 6:
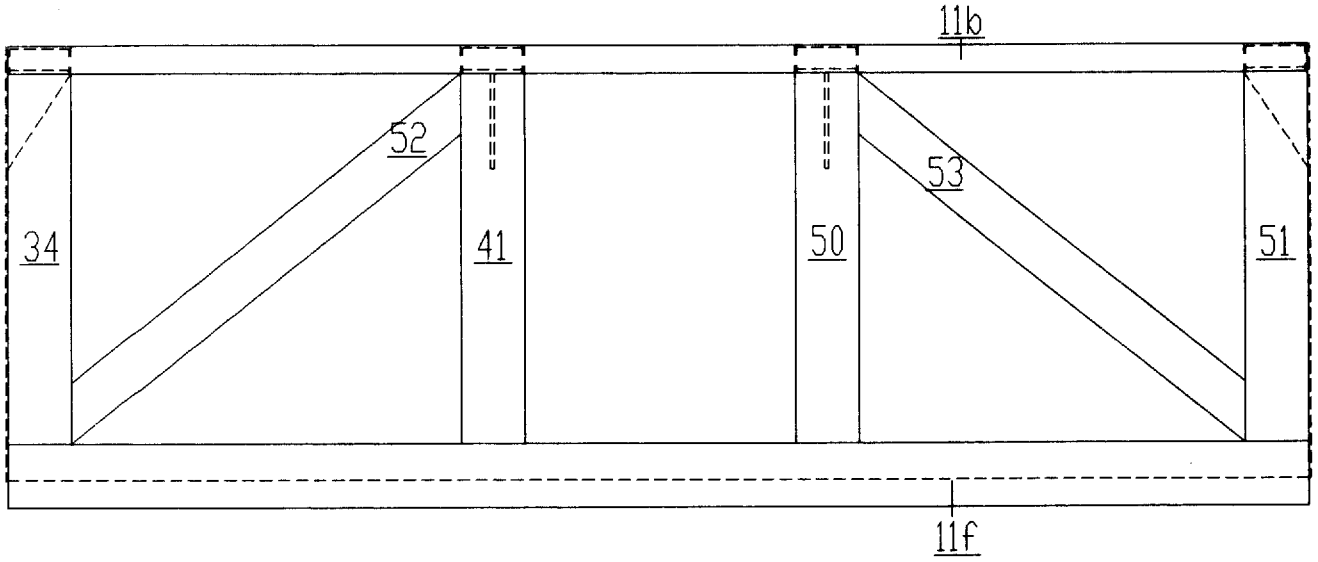
FIG. 6 is an elevational view of the open frame structure of the upright portion of the free-standing cremation memorial.

FIG. 6 is an end elevational view of the base structure 10 looking head on at member 11B, which is superimposed over member 11F. Vertical members 34 and 41, which are box-shaped structural members, are also illustrated in FIGS. 4 and 5 respectively. Members 50 and 51 are also vertical, upright box-shaped structural members. These four upright structural members 34, 41, 50, 51 form the principal vertical support at the end of the lower framework. Cross members, struts 52 and 53, are diagonally in place connecting the tops of members 41 and 50 to add rigidity to the structure. These diagonal struts are located only at each end of the base structure, with the bottoms of members 34 and 51, respectively. Internal struts could be added if more rigidity was desired in the base structure.

Figure 7:
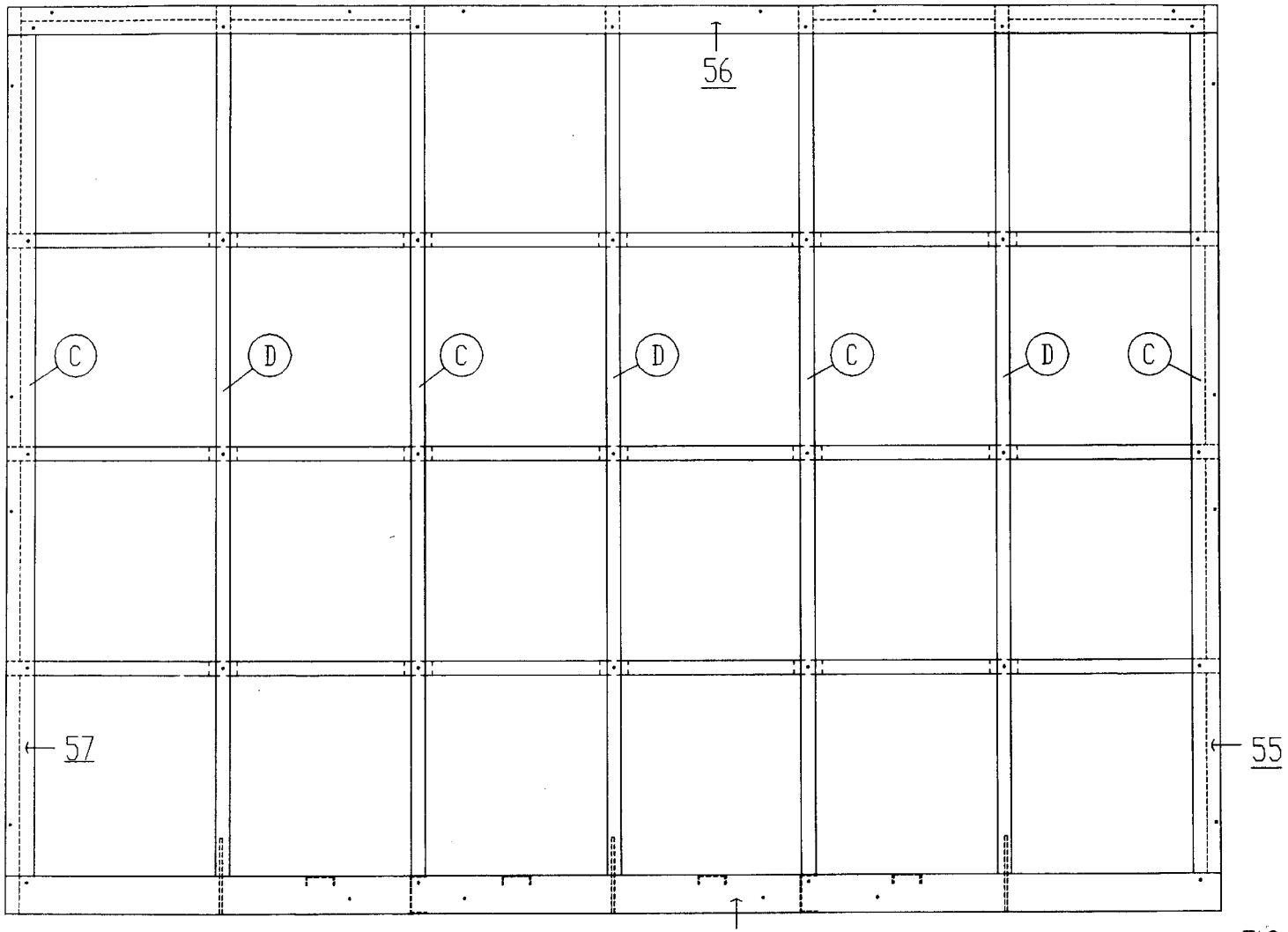
FIG. 7 is the framework of the vertical or upright portion of the cremation memorial.
Figure 8:
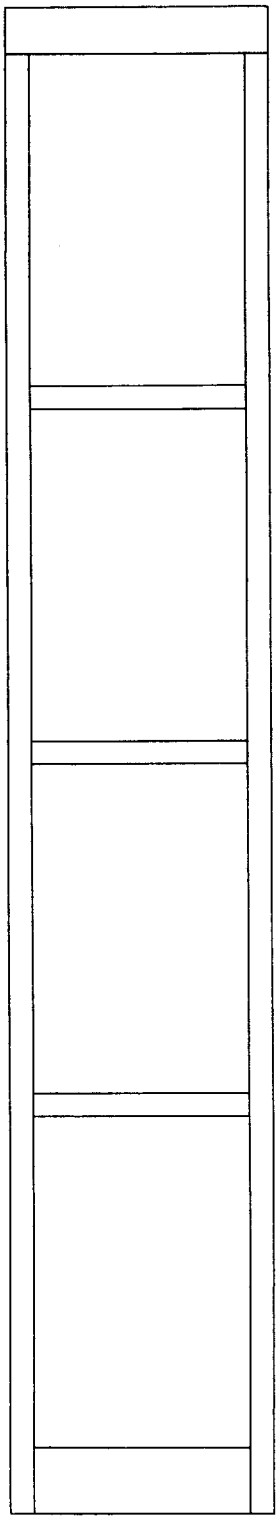
FIG. 8 is an elevational view of frame C of the upright structure of FIG. 7.
Figure 9:
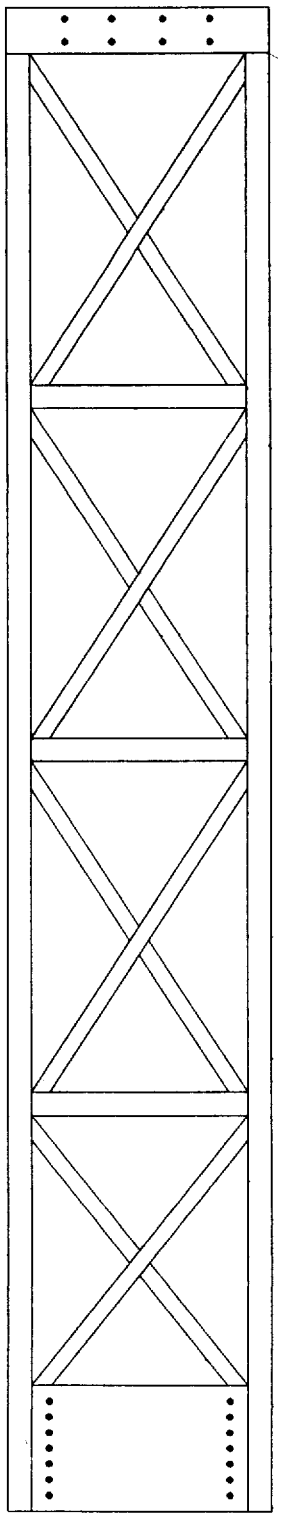
FIG. 9 is an elevational view of frame D of the upright structure of FIG. 7.

FIG. 7 is the framework of the top vertical, upright portion of the cremation memorial. As can be seen from FIG. 7, this top framework is made so that it has substantially equal sized openings both horizontally and vertically throughout its body. A bordering frame is made of members 54, 55, 56 and 57 joined to form a large rectangular framework. The framework is then subdivided by intersecting members to provide twenty-four approximately equal sized open areas. The size and number of such openings may depend upon the overall size of the top structure. The vertical framework structure is further shown in FIGS. 8 and 9. FIG. 8 is an elevational view of frame C as illustrated on FIG. 7. FIG. 9 is the vertical framework of frame D on FIG. 7. The end frame members are formed similar to FIG. 8 while three central frame members D are formed similar to FIG. 9. FIG. 9 and FIG. 8 are similar except that FIG. 9 has cross braces between the vertical and horizontal members and has a support plate which interacts with one of the support upright flange members 25C, 26C and 27C. Each of the three central frames (FIG. 9) has a similar support plate.

Figure 10:
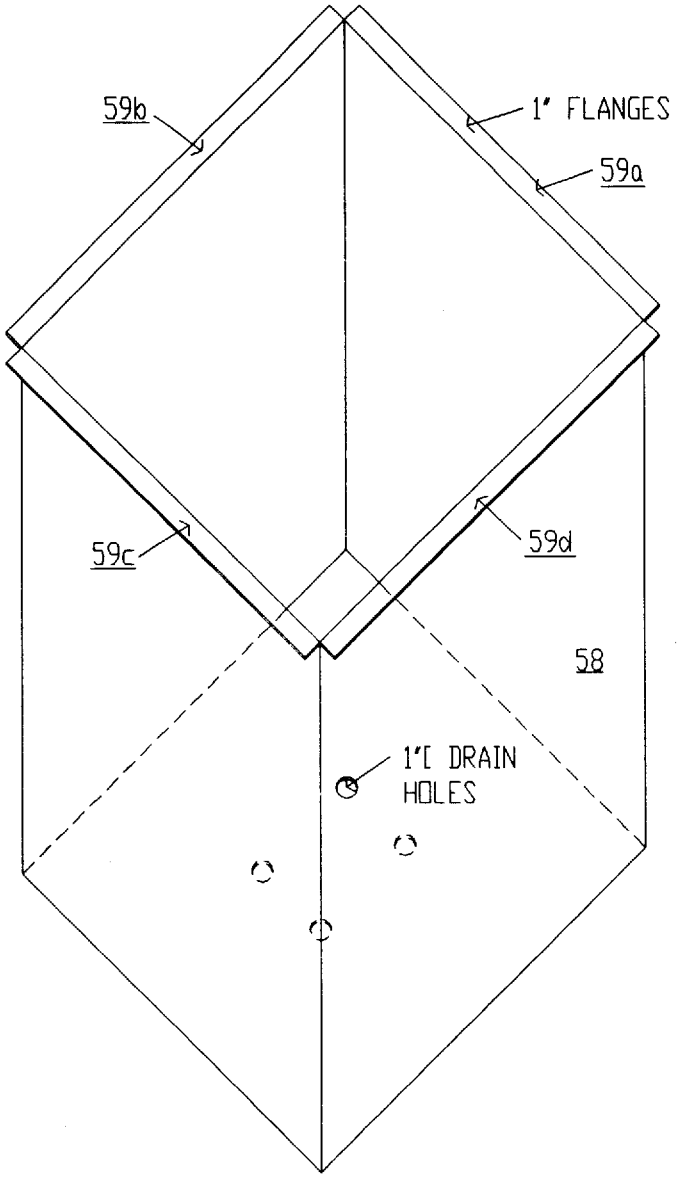
FIG. 10 is a perspective view of a metal chamber container.

FIG. 10 is a perspective view of an underground aluminum container intended to form the external box-like structure which fits within the open framework of the underground frame or foundation. An open box-like structure 58 has flanges 59A, 59B, 59C and 59D around its upper perimeter to hold it in place and rest upon the frame member, for example, frame members 36, 37, 23, and 11C. This aluminum box-like container is made with drain holes in the bottom so in the event moisture gets inside this member, it will drain down into the earth.

Figure 11:
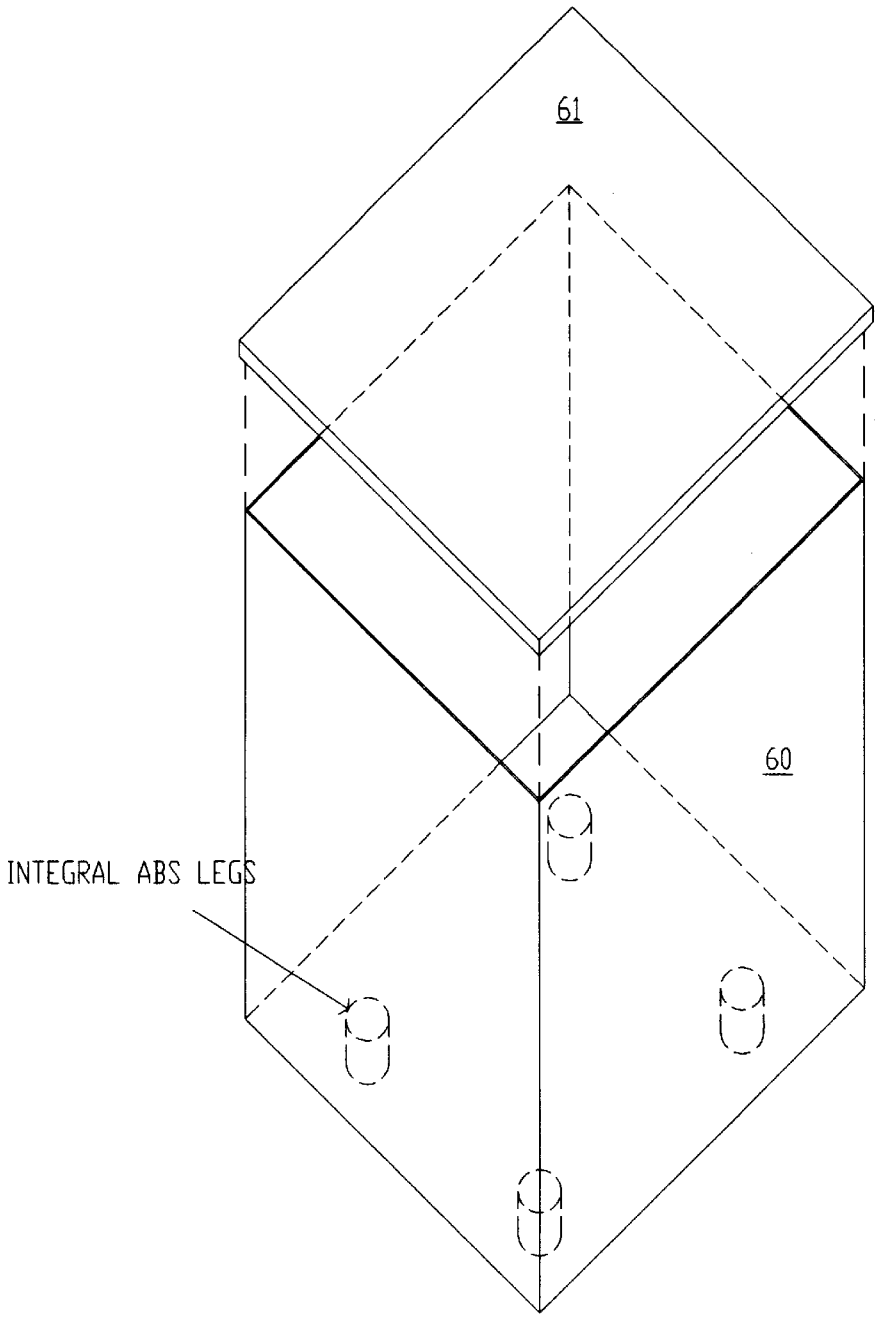
FIG. 11 is a perspective view of a plastic chamber structured to fit within the metal chamber of FIG. 10.

In FIG. 11, a second box-like member 60 is formed and sized to fit within the aluminum container 58. The box-like container 60 is sized slightly smaller than the aluminum container 58 and has short legs, not shown, on the bottom to hold the bottom of the container 60 up off the floor or bottom of container 58 to better permit drainage in the event water gets into container 58. The box 60 has a lid 61 with down-turned edges which fits over the box 60 to prevent water getting into it. The lid 61 and the box 60 are preferable made of a plastic such as an ABS plastic or other material, including aluminum. Thus, containers 58 and 60 form the underground containers for cremation remains. The cremation remains may be placed directly in box 60 or in an urn or other vessel for placement in box 60.

Figure 12:
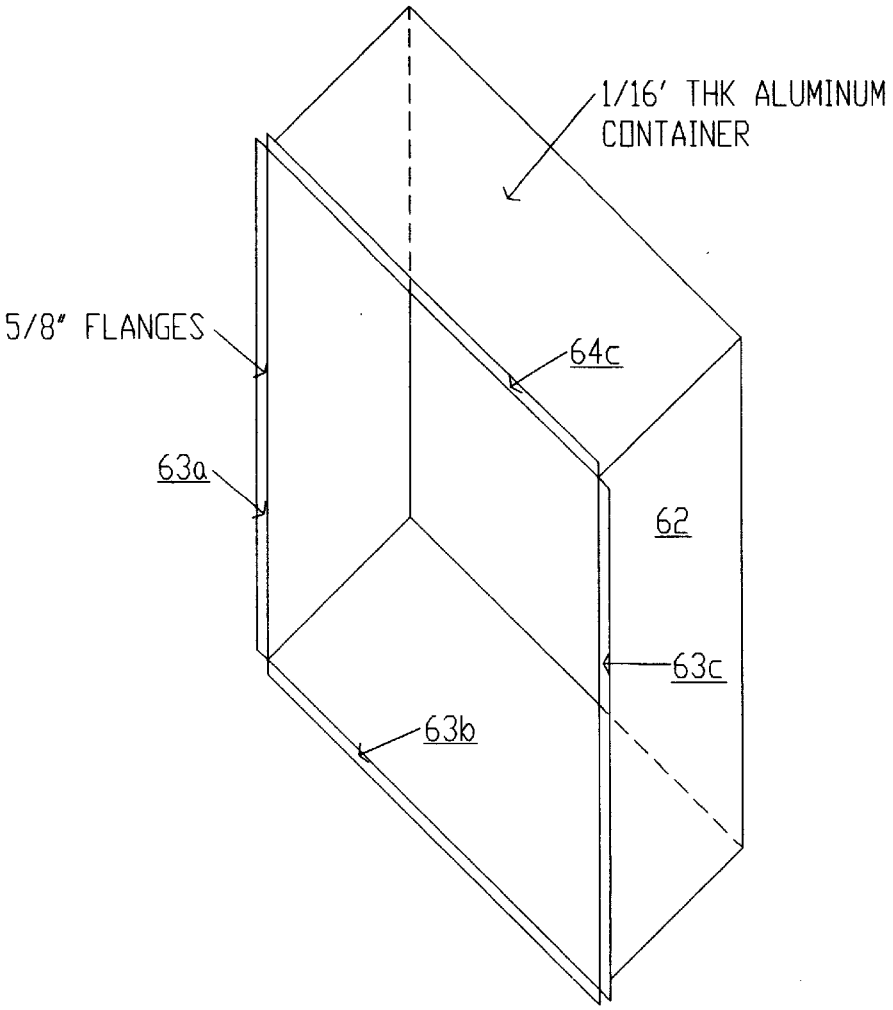
FIG. 12 is a perspective view of a metal box-like member intended to form a niche in the upright portion of the free-standing cremation memorial.

In FIG. 12, a box-like structure having an open face is illustrated and is useful for the upright portion of the cremation memorial. The box-like member 62 is relatively shallow, being only about seven to nine inches deep and about ten to fourteen inches high and about fifteen to twenty inches in width. A pair of the containers 62 are placed in back-to-back relationship so that the open face of each container faces away from the other and is part of the vertical walls of opposing faces of the upright portion or the mausoleum. The container 62 is made with flanges 63A, 63B, 63C and 64C around its open face so that these flanges may interact with the horizontal and vertical members shown in FIG. 7 to seal off the open spaces and to form a niche (compartment) for receiving an urn or other vessel containing cremated remains. Both the underground box and the aboveground box are finished off with a face closure, i.e. door, of granite or similar secure decorative material.

Figure 13:
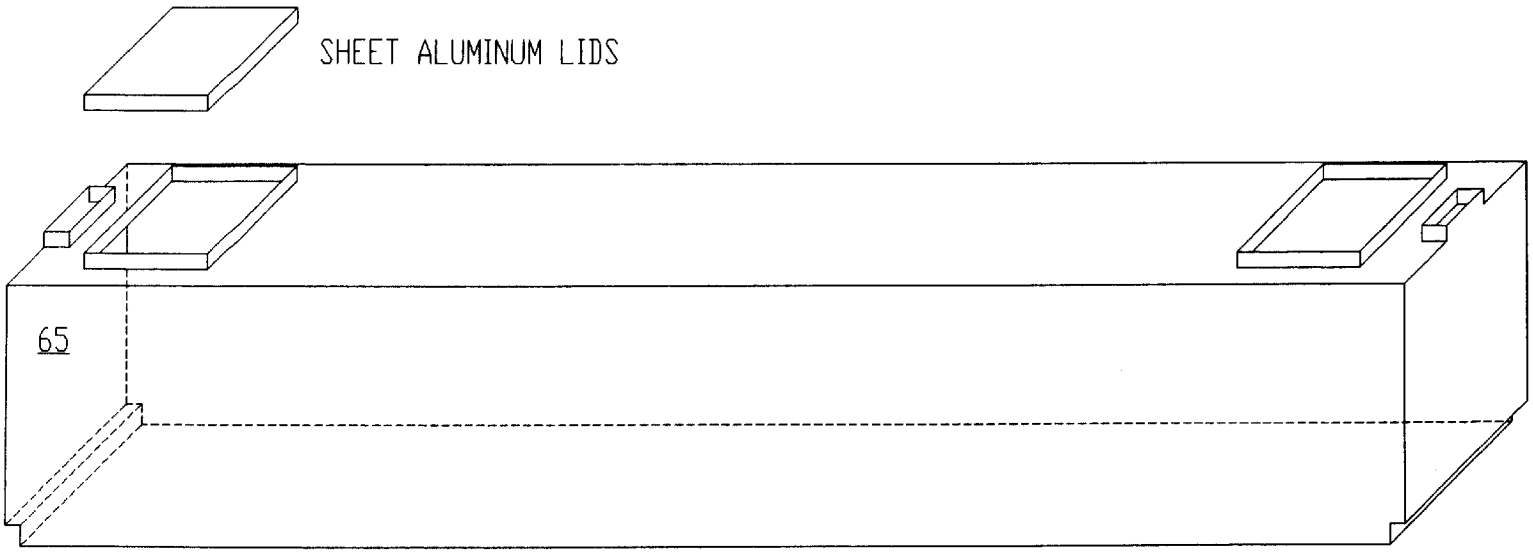
FIG. 13 is an elongated metal container structured to fit beneath the upright portion of the free-standing cremation memorial to act as a common cavity to contain cremation remains.

In FIG. 13, a large aluminum box or tub is illustrated. This tub 65 forms a common chamber for cremation remains. It fits directly under the upright cremation memorial portion and nests in the center between frame members 22A and 22B (see FIG. 3) and upright members 41 and 50 (see FIG. 6). The container 65 is made of aluminum sheet metal and may be welded to the various strut and upright members of the underground foundation frame.

The structure of the instant invention is unique in that the foundation portion of the framework may be prefabricated and formed into a framework structure generally having maximum dimensions of about seven to eight feet in width and about twelve feet in length and generally less than about two and one-half feet in thickness, while the upright portion of the cremation memorial has a height generally of about eight feet or less and a length again of less than about twelve feet and an overall thickness of generally less than about one and one-half feet. Structures in prefabricated form may be readily transported by flatbed truck without requiring any oversize permits. Heights up to eight feet may be readily transported on flat bed trucks or trailers in most portions of the country without interfering with overpasses and the like. Also many larger trucks have beds which are eight feet wide so that the structures may be laid down and not require an oversize permit. Thus, once the footers are positioned, the foundation framework may be secured to the footers and the upright portion of the mausoleum secured to the foundation. Also, if desired, the aluminum boxes may be welded into the base structure and into the upright portion so that the complete mausoleum structure requires minimal assembly at an internment site.

What is claimed is:

1. A free-standing cremation memorial for holding cremated remains comprising:

a light-weight, upright, prefabricated, integrated modular structure having an aluminum support frame and a plurality of niche compartments sized to accept a cremation vessel, said compartments formed by panel members attached to said support frame, each of said compartments has an outward-facing opening closed by a solid door panel member which forms part of the facade of the face of said upright modular structure;

a light-weight, prefabricated, integrated base structure supporting and orienting said upright modular structure, said base structure having an aluminum support frame supporting a plurality of niche chambers, each having an opening facing upward, each chamber adapted and structured with sealing means around said opening which seals the niche chamber from water entry in cooperation with a door panel member secured to the niche chambers; and base attachment means on said base structure attaching said base structure to said upright modular structure.

2. The free-standing cremation memorial of claim 1, wherein said door panel member secured to said niche chamber is a stone closure.

3. The free-standing cremation memorial of claim 1, wherein said upright modular structure has a pair of upright opposed faces and is constructed to have said niche compartments positioned back-to-back to have said outward-facing openings on both upright faces of said upright modular structure.

4. The cremation memorial of claim 1, wherein said upright modular structure has at least about 24 niche compartments per face of said upright modular structure.

5. The cremation memorial of claim 1, wherein each said niche compartment is formed by a shallow, unitary pan insert.

6. The cremation memorial of claim 1, wherein a pair of pans is positioned back-to-back in opposed frame openings to form back-to-back said niche compartments.

7. A free-standing cremation memorial for holding cremated remains comprising:

a lightweight prefabricated, integrated modular structure having an aluminum support frame and a plurality of niche compartments having a front opening and rear panel, said niche compartments sized to accept a cremation vessel, said compartments formed by panel members attached to said support frame, said front opening closed by a solid door panel which forms part of said upright modular structure and wherein a rear region of each said compartment is separated from a rear region of an adjacent said compartment by said rear panel so that said upright modular structure has said niche compartment front openings on opposed faces of said upright modular structure; and securing means attached to said support frame of said upright modular structure to anchor said structure to a concrete pad.

* * * * *